US010179980B2

(12) United States Patent
Godin

(10) Patent No.: US 10,179,980 B2
(45) Date of Patent: Jan. 15, 2019

(54) A-FRAME STAND

(71) Applicant: Clarence Godin, Village Blanchard (CA)

(72) Inventor: Clarence Godin, Village Blanchard (CA)

( * ) Notice: Subject to any disclaimer, the term of this patent is extended or adjusted under 35 U.S.C. 154(b) by 25 days.

(21) Appl. No.: 14/664,685

(22) Filed: Mar. 20, 2015

(65) Prior Publication Data

US 2015/0267363 A1 Sep. 24, 2015

Related U.S. Application Data

(60) Provisional application No. 61/968,299, filed on Mar. 20, 2014.

(51) Int. Cl.
*E04H 17/14* (2006.01)
*E01F 13/02* (2006.01)

(52) U.S. Cl.
CPC ..... *E01F 13/02* (2013.01)

(58) Field of Classification Search
CPC ..... E01F 13/02; E01F 13/12; E01F 15/00; B25H 1/06
USPC ..... 256/13.1, 64, 12, 31, 53; 182/186.4, 182/186.5, 181.1; 404/6, 9, 10
See application file for complete search history.

(56) References Cited

U.S. PATENT DOCUMENTS 565,338 A * 8/1896 Ernest ..... E04H 17/16 182/186.1
2,541,508 A * 2/1951 Fleming ..... B25H 1/06 144/286.1
3,858,682 A * 1/1975 Larson ..... B25H 1/06 182/153
4,008,786 A * 2/1977 Canavan ..... A47B 13/02 182/151
4,494,627 A * 1/1985 Arent ..... B25H 1/06 182/129
4,756,386 A * 7/1988 Blanchard ..... B25H 1/06 182/153
4,966,309 A * 10/1990 Baer ..... A63G 9/00 248/165
5,102,078 A * 4/1992 Nordeng ..... E04G 1/34 182/186.1
5,297,655 A * 3/1994 Wolfe ..... B25H 1/06 182/153
5,427,200 A * 6/1995 Yemini ..... B27B 17/0041 182/153
5,566,901 A * 10/1996 Wilder ..... B65H 54/585 242/395
6,039,654 A * 3/2000 Zeilinger ..... A63G 9/12 248/165

(Continued)

*Primary Examiner* — Amber R Anderson
*Assistant Examiner* — Nahid Amiri
(74) *Attorney, Agent, or Firm* — Heidi L. Eisenhut; Loza & Loza, LLP

(57) ABSTRACT

One feature provides an A-frame stand which allows the fabrication of a barricade while using less stands. The A-frame generally provides a first and second leg to provide stable support for the A-frame, as well as at least one interconnector to increase the rigidity. The interconnectors may be comprised of first and second contact points to receive barricade beams, and there may be a gap in between the opposing legs wide enough so that a barricade beam can be placed therein while allowing some pivotal movement to create the barricade.

12 Claims, 9 Drawing Sheets

(56) References Cited

U.S. PATENT DOCUMENTS

| | | | | |
|---|---|---|---|---|
| 6,092,627 | A * | 7/2000 | Burger | B25H 1/06 182/153 |
| 6,612,401 | B1 * | 9/2003 | Price | B25H 1/06 182/153 |
| 6,761,249 | B2 * | 7/2004 | Garcia | A47F 5/13 182/153 |
| 8,376,291 | B1 * | 2/2013 | Groves | B25H 1/06 182/153 |
| 8,424,644 | B2 * | 4/2013 | D'Abbraccio | E01F 13/022 182/181.1 |
| 8,708,103 | B2 * | 4/2014 | Bulley | B25H 1/06 182/153 |
| 2010/0006734 | A1 * | 1/2010 | Connell | B25H 1/06 248/440 |

* cited by examiner

A-FRAME STAND

CLAIM OF PRIORITY

The present application for patent claims priority to U.S. Provisional Application No. 61/968,299 entitled "A-Frame Stand" filed Mar. 20, 2014, the entire disclosure of which is hereby expressly incorporated by reference herein.

BACKGROUND

Field

The present invention relates to the field of barricades, and more specifically to an improved A-frame stand used to create barricades.

Background

Barricades, and more specifically an A-frame stand for use with barricades, are well-known in the art and have been around for years. Various types of barricades and their accompanying frame types have been devised in order to create sturdy and long-lasting barricades.

Many inventions have been devised in order to perfect the construction and stability of barricades. Patents such as U.S. Pat. No. 4,050,401 (Kelly), U.S. Pat. No. 5,467,548 (Ross), and U.S. Pat. No. 8,591,137 (Thompson) are examples that illustrate various types of these aforementioned barricades.

Specifically, Kelly's device discloses a type of barricade, not being an A-frame, with a support head at each upper extremity of the barricade. The support heads have two slotted portions therein, in order to support multiple types of beams, including the standard 2×4 beam. There are also two support posts protruding downward from the support heads which are fitted within base pan units having cone structures in order to provide support from the entire barricade assembly. Unfortunately, Kelly's device is impractical as it is cumbersome and comprised of many parts. Since the purpose of Kelly's device is to allow for a plethora of interchangeable parts, it is prone to breakage or losing the various parts. Further, and more importantly, the shape of the slotted portions does not allow for many barricades to be utilized to create a closed-off environment.

Meanwhile, Ross's device discloses a barrier that is adapted to be easily mounted and de-mounted from conical pylons that already exist in the workplace. Indeed, pylon-engaging members are utilized which can be fitted into the upper portion of the pylon, and connect to adjacent barrier members to connect many cones. Firstly, this system is inconvenient due to its height, which is limited by the height of the pylons themselves. Second, appropriate barrier members need to be purchased in order to combine many of them side by side; it does not use existing 2×4s that are omnipresent in the workplace. Finally, the device overall is very precarious and can easily be pushed aside when applying forward motion, as the pylons themselves are designed in plastic and thus not particularly stable.

Thompson uses an improved A-frame barricade which allows for the assembly of multiple barricades to close off a particular section. A lower end of the barricade is comprised of a lower cross leg which has central portion to fit in a lower beam. The lower beam can be locked in between each cross central portion of the cross leg, which in turns loosely secures one barricade to another. One of the shortcomings of this device is that, like Ross, it utilizes many parts which can be lost or misplaced during operation. Further, it is cumbersome to adjoin or dismantle many of the barricades due to the complexity of the linking system.

Other devices such as U.S. Pat. No. 3,089,682 (Parker) and U.S. Pat. No. 5,765,444 (Giannelli) are similar in nature and have the same drawbacks as described above.

As such, an improved A-frame stand is needed which is both sturdy and simple in nature, in order to overcome the aforementioned shortcomings of the inventions listed above. Specifically, an improved A-frame stand which can provide a barrier at a normal height requiring less stands than commonly used in the industry. Such an improved A-frame stand will be described below.

SUMMARY

The present invention provides an A-frame for use in barricades comprising first and second opposing legs to provide stable support for the A-frame; one or more interconnecting means connecting the first and second opposing legs for providing increased rigidity to the A-frame, further comprised of first and second contact points to receive barricade beams; and, a gap between the first and second opposing legs having a width larger than the width of the barricade beams to allow for the movement of the barricade beams.

DETAILED DESCRIPTION

The present invention will now be described more fully hereinafter with reference to the accompanying drawings, in which preferred and other embodiments of the invention are shown. No embodiment described below limits any claimed invention and any claimed invention may cover processes or apparatuses that are not described below. The claimed inventions are not limited to apparatuses or processes having all the features of any one apparatus or process described below or to features common to multiple or all of the apparatuses described below. It is possible that an apparatus or process described below is not an embodiment of any claimed invention. The applicants, inventors or owners reserve all rights that they may have in any invention claimed in this document, for example the right to claim such an invention in a continuing application and do not intend to abandon, disclaim or dedicate to the public any such invention by its disclosure in this document.

Figure 1:
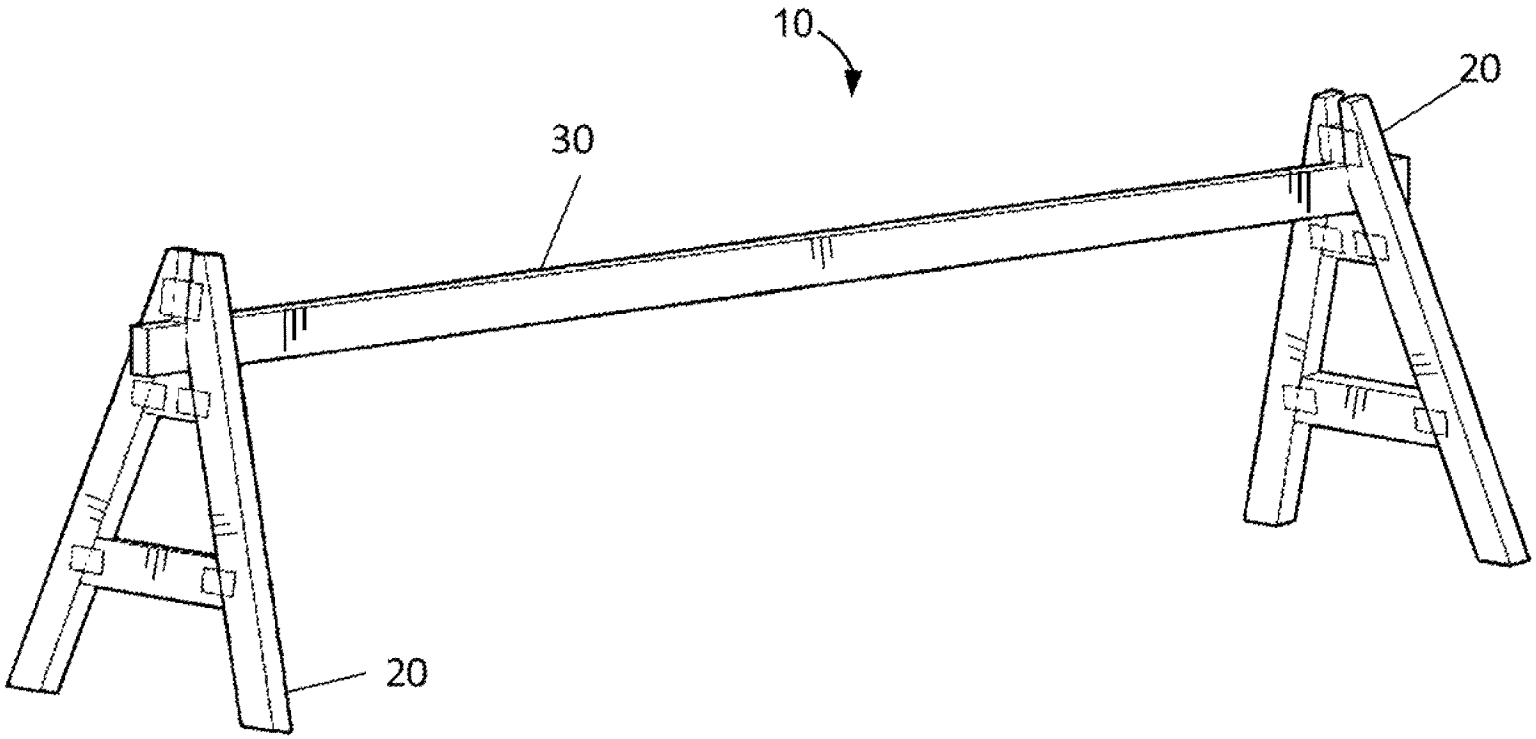
FIG. 1 is a perspective view of a barricade using improved A-frame stands according to one embodiment of the present invention.

With reference to FIG. 1, a barricade 10 is shown with two improved A-frame stands according to one embodiment of the present invention. The barricade has two improved A-frame stands 20 with a barricade beam 30. The A-frame stands 20 are interconnected by barricade beam 30 and form a barricade. The barricade shown in FIG. 1 is the minimum number of A-frame stands 20 required to create a basic barricade using the A-frame stands of the present invention.

Figure 2:
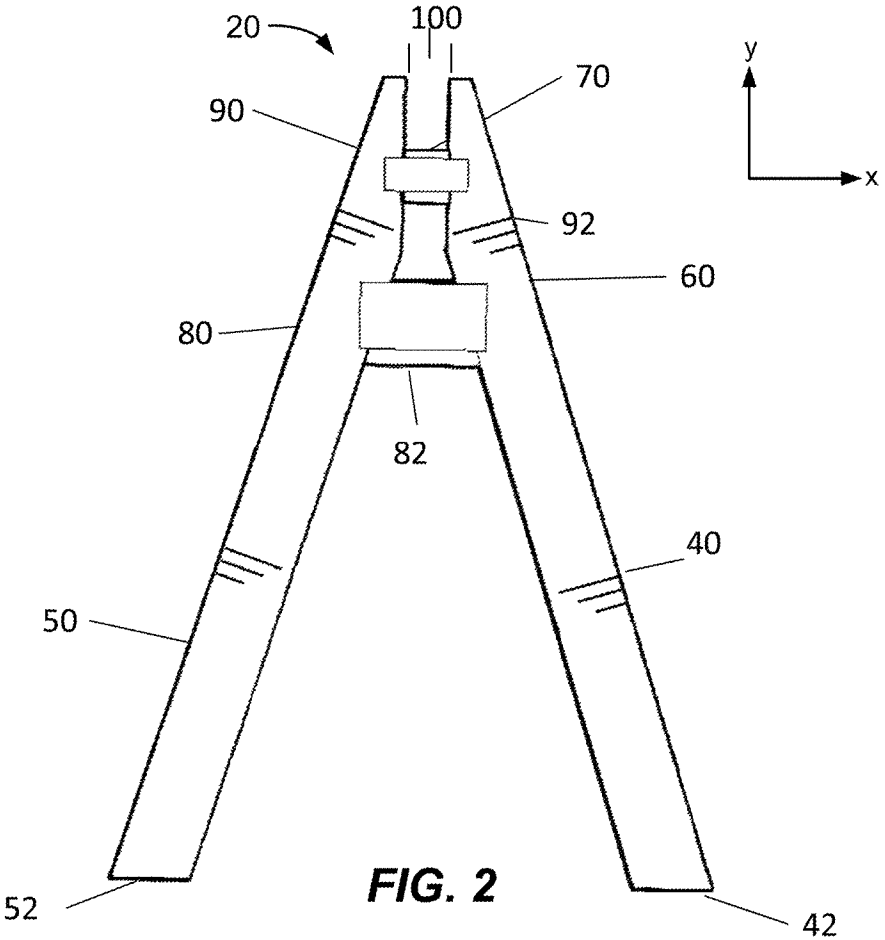
FIG. 2 is a front view of an A-frame stand according to one embodiment of the present invention.

With reference to FIG. 2 and according to one embodiment of the present invention, an improved A-frame stand 20 is shown. A first and second leg 40 and 50 are shown providing opposing legs for the A-frame stand 20. In one embodiment of the present invention, opposing legs 40 and 50 are made of wood and have identical shapes. A worker skilled in the relevant art would be familiar with the use of other materials for the fabrication of opposing legs 40 and 50 such as steel, aluminum, or composite materials for example. The contact points 42 and 52 of opposing legs 40 and 50 have to be at the same level otherwise an uneven barricade would be created which would be unsafe and not level.

With further reference to FIG. 2 and according to one embodiment of the present invention, the improved A-frame stand 20 has a first contact point 60 for receiving a barricade beam (not shown). A second contact point 70 for receiving a barricade beam is also present on the improved A-frame stand 20. The first and second contact points 60 and 70 are positioned between opposing legs 40 and 50 and are in alignment and are positioned one on top of another such that second contact point 70 is above first contact point 60. A worker skilled in the relevant art would be familiar that the first and second contact points 60 and 70 could be off-set rather than in alignment as shown in FIG. 2 and still allow for the creation of a barricade. With further reference to FIG. 2 and according to one embodiment of the present invention, the improved A-frame stand 20 has interconnecting means 80 and 90 interconnecting first and second legs 40 and 50. Interconnecting means 80 and 90 are steel studded plates commonly used in the trust industry. A worker skilled in the relevant art would be familiar with other means to interconnect opposing legs 40 and 50 such as screws, nails, glue or finger joints for example. Spacers 82 and 92 are also present between opposing legs 40 and 50 allowing for a gap 100 to be created between opposing legs 40 and 50. Gap 100 will be further described below in respect of the first and second contact points 60 and 70. The presence of the interconnecting means 80 and 90 also provide increased rigidity to the A-frame stand 20 which does not require any further support to be positioned between first and second legs 40 and 50. In another embodiment, spacers 92 and 82 could be removed and the use of interconnecting means 80 and 90 would provide first and second contact points 60 and 70 respectively. For example, interconnecting means 80 and 90 under such an embodiment could consist of steel plates allowing for the creation of gap 100 and first contact point 60 on interconnecting means 80 and second contact point 70 on interconnecting means 90. In yet another embodiment, the interconnecting means 80, 90 consisting of steel plates could be present on both sides of A-frame stand 20 for a total of four interconnecting means. In another embodiment, interconnecting means 92 could also be present on both sides of A-Frame stand 20 for a total of two interconnecting means 92. A single interconnecting means 92 could be used to create a functional A-frame stand 20 of the present invention. The use of two interconnecting means such as interconnecting means 80 and 90 could also be used to create a functional A-frame stand 20 of the present invention.

Figure 2A:
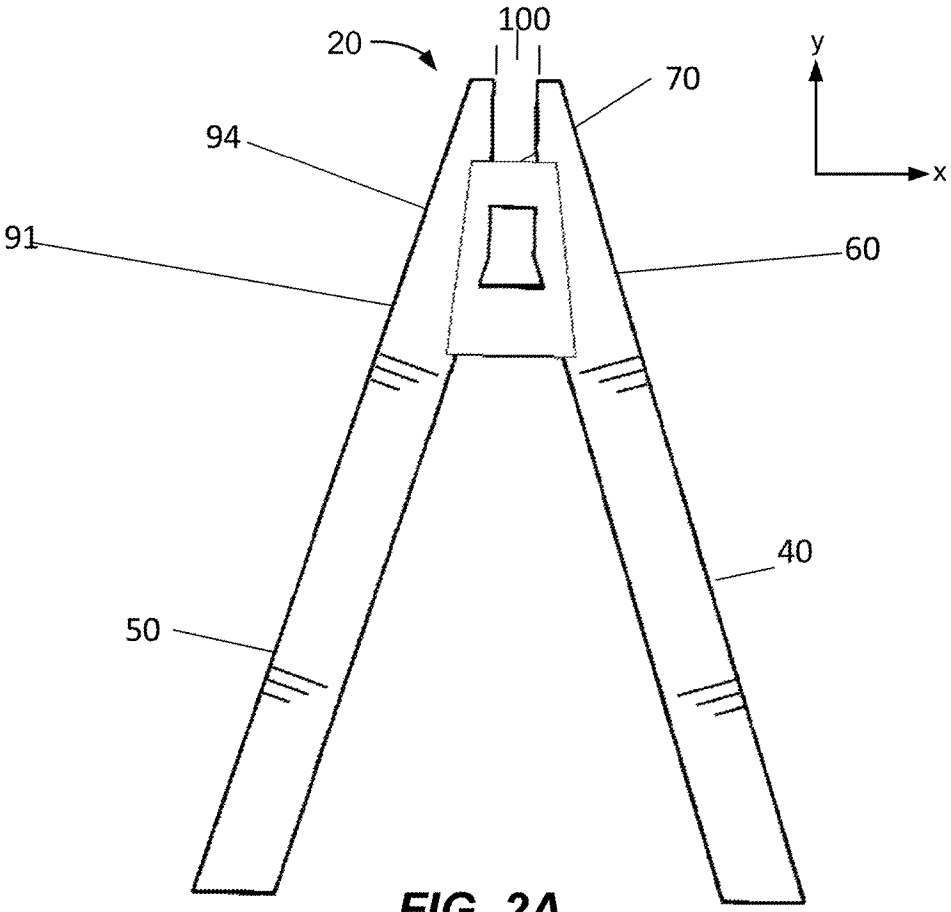
FIG. 2*a* is a front view of an A-frame stand according to a second embodiment of the present invention.

With reference to FIG. 2*a* and according to a second embodiment of the present invention, spacers (not shown) could be removed and the use of a single interconnecting means 91 could still provide first and second contact points 60, 70 for the positioning of a barricade beam (not shown). Said single interconnecting means 91 could consist of a solid steel member with an aperture 94 allowing to interconnect opposing leg 40 and 50 and creating gap 100 and first and second contact points 60 and 70.

Figure 3:
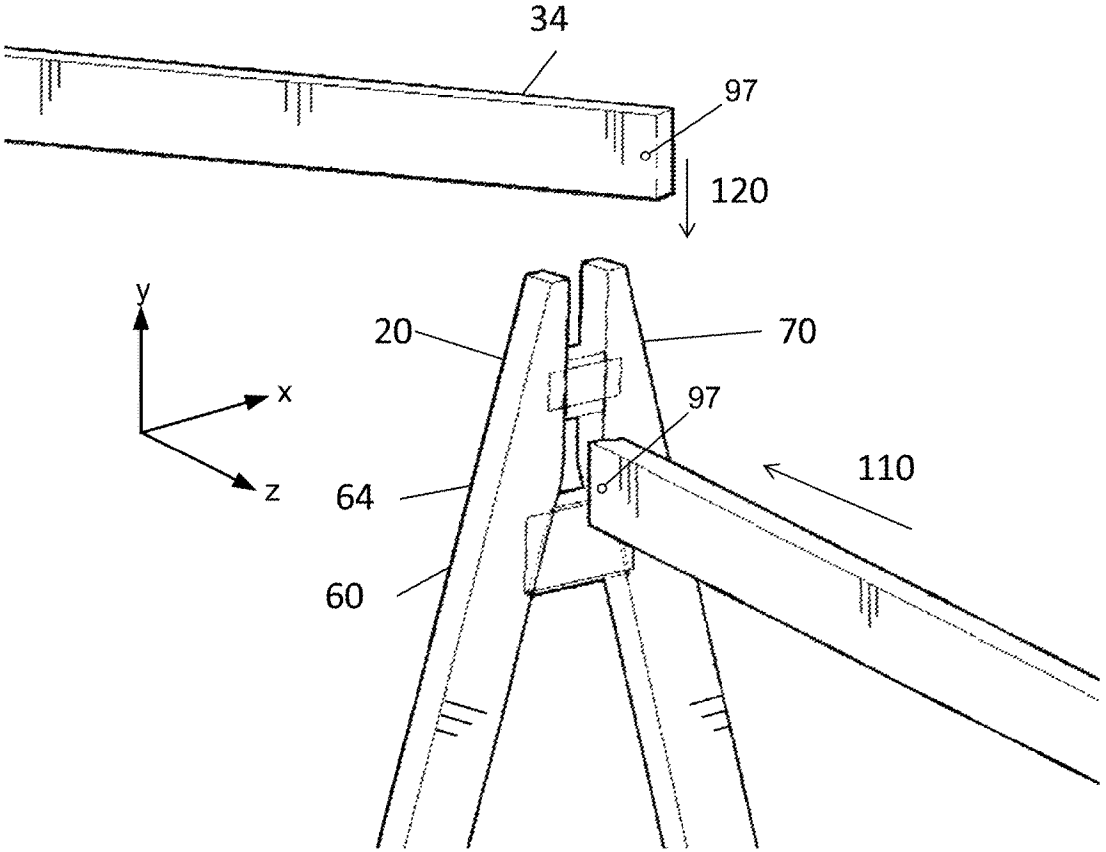
FIG. 3 is a perspective view of an A-frame stand with barricade beams prior to placement on the A-frame stand according to one embodiment of the present invention.

With reference to FIG. 3 and according to one embodiment of the present invention, the A-frame stand 20 is shown with barricade beams 32 and 34 prior to placement on A-frame stand 20. Barricade beam 32 will be positioned on first contact point 60 through a forward movement as shown by arrow 110. The first contact point as shown in FIG. 3 is in the form of an aperture 64 allowing for barricade beam 32 to travel through A-frame 20. Barricade beam 34 can be positioned on second contact point 70 through a displacement of barricade beam 34 as shown by arrow 120. The second contact point 70 has a u-shape allowing for the positioning of barricade beam 34 by either insertion or displacement of barricade beam 34 on top of the A-frame stand 20. The second contact point 70 could also be composed of an aperture rather than a u-shape form as shown in FIG. 3 which would not allow the removal of barricade beam 34 from the top of A-frame stand 20. Under such an embodiment, barricade beam would need to be inserted into second contact point in a similar fashion as barricade beam 32 is positioned on contact point 60. Referring to FIGS. 3 and 9, in another embodiment, barricade beams 32 and 34 could have locking apertures 97 at the end of each barricade beam such that a pin 99 could be inserted into these locking apertures 97 which would restrict the movement of the barricade beams through the apertures of first and second contact point 60 and 70.

Figure 4:
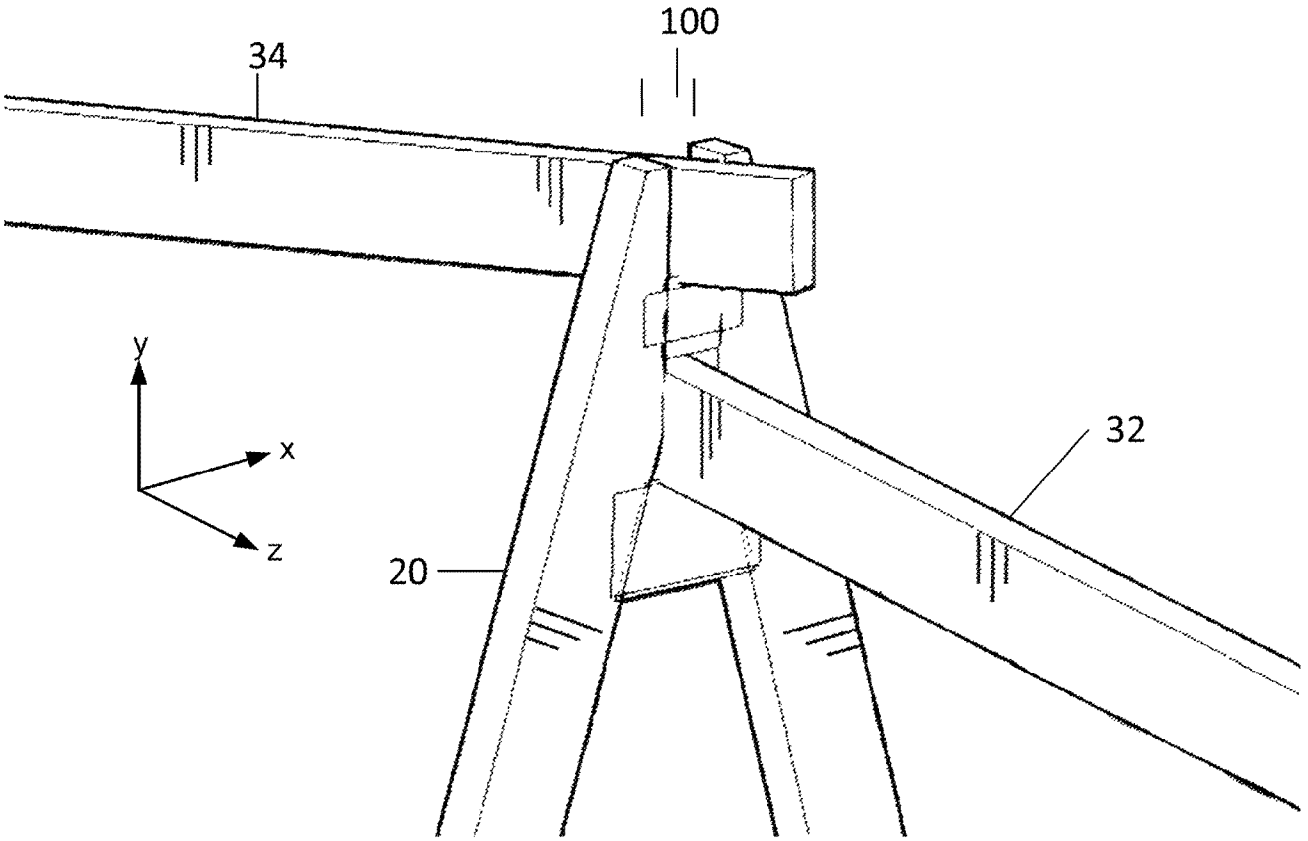
FIG. 4 is a perspective view of an A-frame stand with barricade beams positioned on the A-frame stand according to one embodiment of the present invention.

With reference to FIG. 4 and according to one embodiment of the present invention, barricade beams 32 and 34 are positioned onto A-frame stand 20. The barricade beam 32 is positioned onto first contact point 60 and barricade beam 34 is positioned onto second contact point 70. Gap 100 of first and second contact points 60 and 70 allows for movement of barricade beams 32 and 34 once positioned onto A-frame stand 20. With further reference to FIG. 4 and according to one embodiment of the present invention, barricade beam 34 is not positioned perpendicular to a plane parallel (i.e., "depth plane") to the y-z plane of the A-frame stand 20 as barricade beam 32. The gap 100 has a gap width (e.g., horizontal width, i.e., width along x-axis) which is larger than the width of barricade beam 32 and 34. The greater width of gap 100 allows for the movement of barricade beams 34 as shown in FIG. 4 (i.e., beams 34 to be at an angle relative to a depth plane parallel to y-z plane) since if gap 100 was equal to the width of a barricade beam, movement of barricade beam 34 would be limited if not limited to a the placement of barricade beam at a 90 degree angle with A-frame stand 20. The placement and movement of barricade beams 32 and 34 will be further described below. In another embodiment, opposing legs 40 and 50 could have a connecting member at the top end of opposing legs 40 and 50 (not shown) creating a secondary aperture enclosing gap 100 and second contact point 70.

Figure 5:
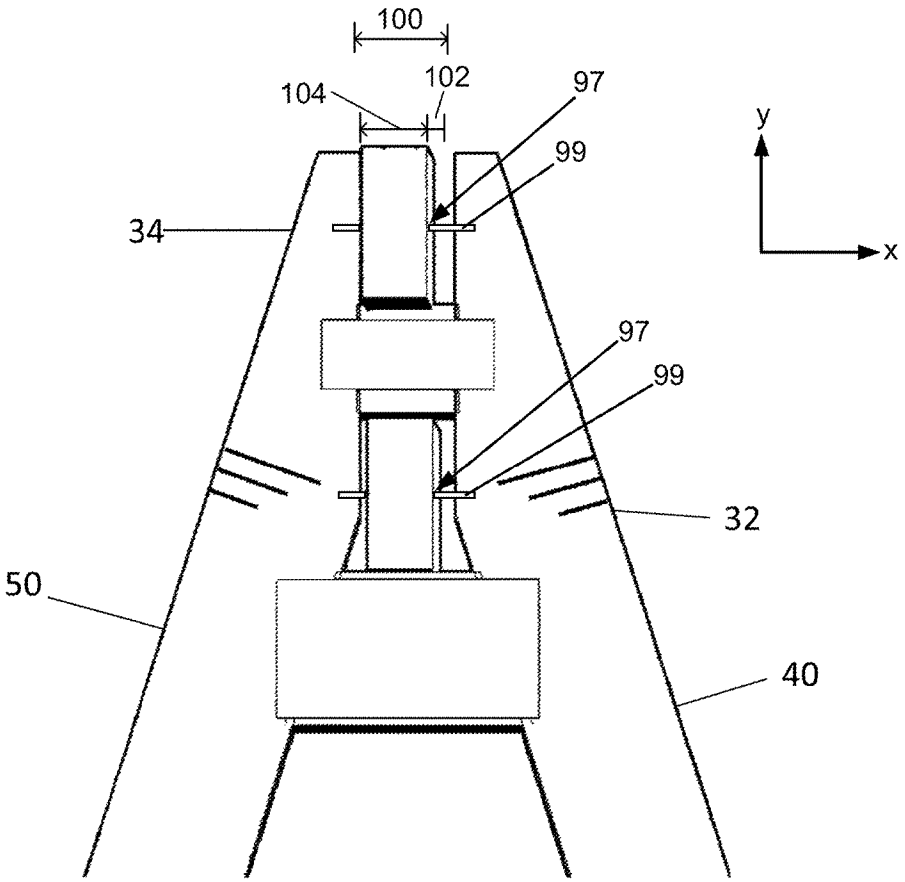
FIG. 5 is a front view of an A-frame stand with both barricade beams positioned perpendicular to an A-frame stand according to one embodiment of the present invention.

With reference to FIG. 5 and according to one embodiment of the present invention, barricade beams 32 and 34 are both positioned perpendicular to A-frame stand 20. The flexibility of use of A-frame stand 20 is achieved through gap 100 which is comprised of movement width 102 and barricade beam width 104 of barricade beam 34. The presence of movement width 102 allows for the movement of barricade beam 34 other than being perpendicular to the depth plane of the A-frame stand 20. The establishment of movement width 102 is based on the width of the barricade beam being used to create the barricade. For example and with further reference to FIG. 5, barricade beam 34 is comprised of a standard 2×4 lumber which has a width of 1.5 inches. Based on this width of barricade beam 34, movement width 102 would be 0.75 inches providing a total width (e.g., horizontal width) of 2.25 inches for gap 100. In another example, if barricade beam 34 has a width of 3 inches then gap 100 will have a width of 3.75 inches since movement width 102 will add an additional 0.75 inches to gap 100 based on the use of a barricade beam having a width of 3 inches. Movement width 102 can vary from a range of 0.5 inches to 3 inches and still be within the scope of this invention.

Figure 6:
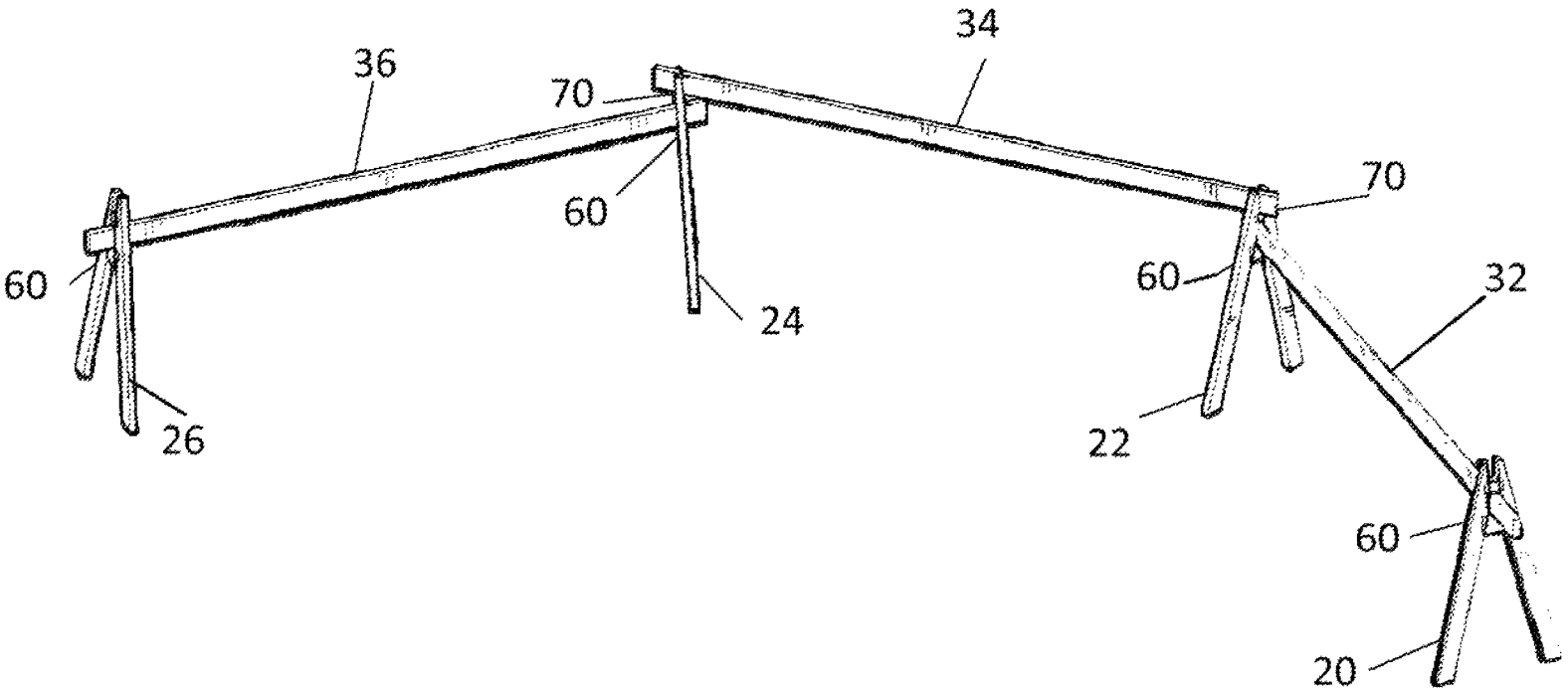
FIG. 6 is a perspective view of an extended barricade incorporating the use of A-frame stands according to one embodiment of the present invention.
Figure 7:
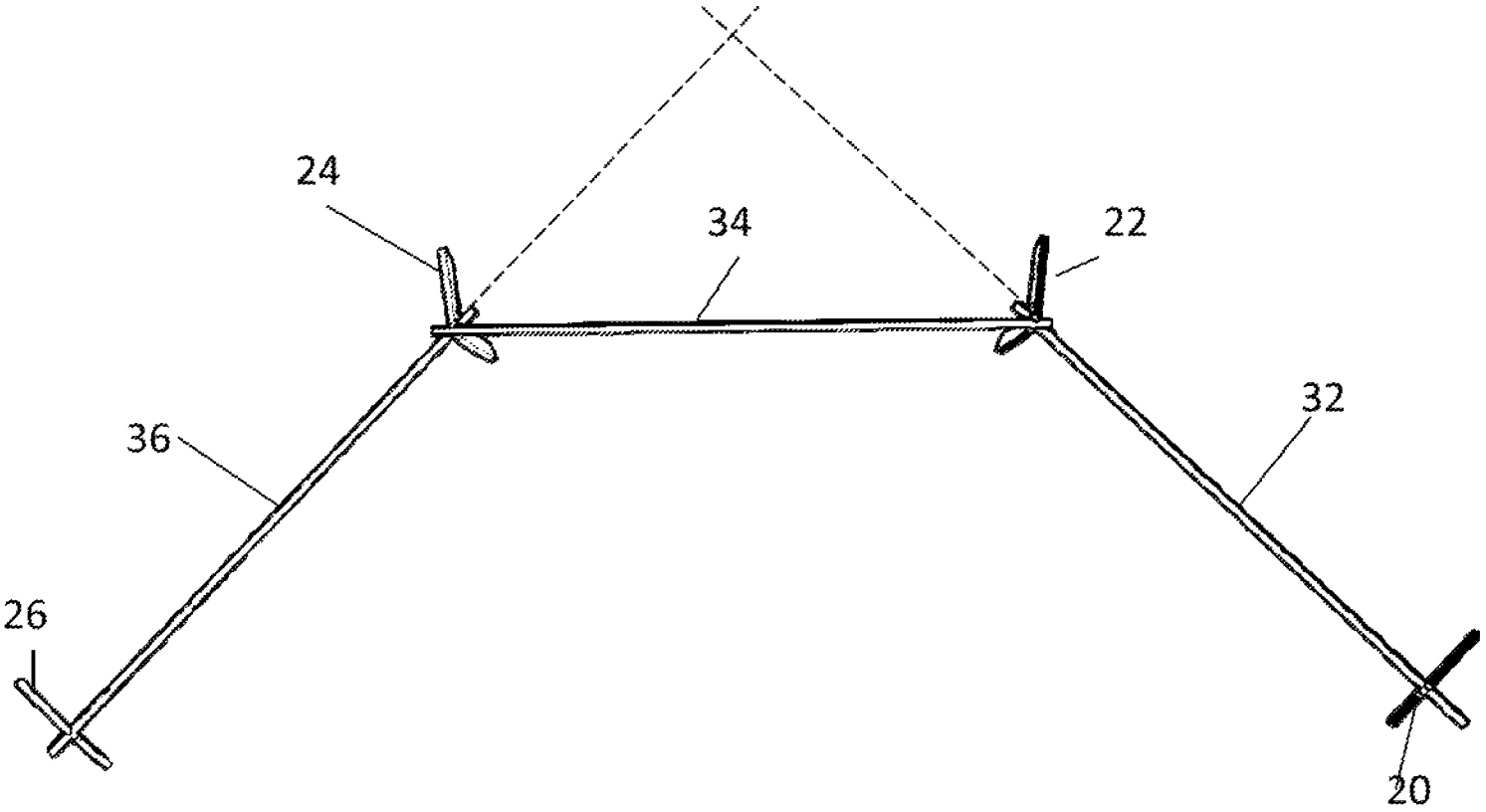
FIG. 7 is a top of the extended barricade as shown in FIG. 5.

With reference to FIGS. 6 and 7 and according to one embodiment of the present invention, an extended barricade 150 is shown using a number of barricade beams 32, 34 and 36 and A-frame stands 20. The use of A-frame 20 allows the creation of a barricade using less stands as would be used in common barricades which would require at least two stands for each barricade beam 30. With further reference to FIG. 5, a total of 4 A-frame stands are required to support barricade beams 32, 34 and 36 whereas current practices would require a minimum of six stands to support barricade beams 32, 34 and 36. Each barricade beams 32, 34 and 36 in current barricades require a stand for each end. The second contact points 70 of A-frame stands 22 and 24 allow for the placement of barricade beam 34. Barricade beams 32 and 36 are supported at one end through first contact point 60 of A-frame stands 20 and 26 with opposing end of barricade beams 32 and 36 supported by first contact points 60 of A-frame 24 and 22.

With further reference to FIGS. 6 and 7 and according to one embodiment of the present invention, the gap (not shown) on A-frame stands 20, 22, 24 and 26 allow for barricade beams 32, 34 and 36 to be displaced in a manner that creates a 90 degree turn between barricades 32 and 36 through the presence of barricade beam 34. The presence of beam 34 provides greater coverage for a barricade while allowing a 90 degree turn (as shown through dotted lines extending from barricade beam 32 and 36) in barricade 150 without the need for additional stands as currently used in the industry. The gap present in A-frame stands 22 and 24 also allow for the movement of A-frame stands 22 and 24 in a non-perpendicular position in relation to barricade beams 36 and 32. For example and in contrast, A-frame stands 20 and 26 are positioned perpendicular to barricade beams 32 and 36. The ability to move the position of A-frame stands 24 and 22 in relation to the barricade beams through the gap provides a greater flexibility in building a non-linear barricade with minimum stands as commonly used in the industry.

Figure 8:
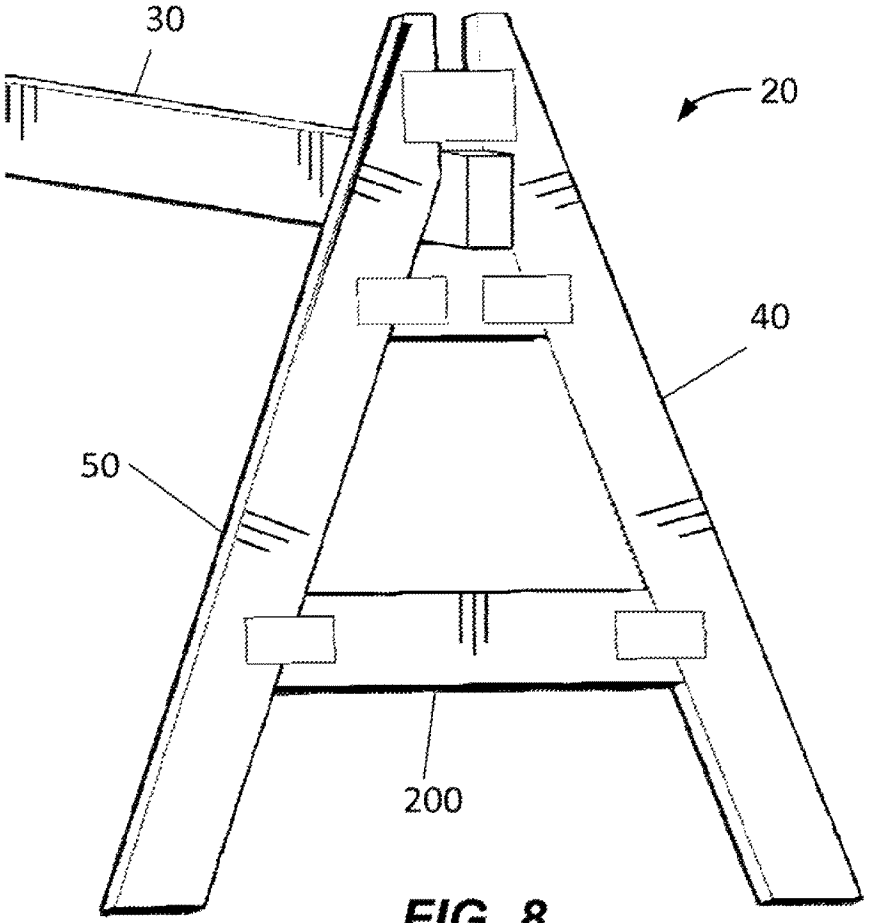
FIG. 8 is a perspective view of a reinforcement member positioned on an A-frame stand according to one embodiment of the present invention.

With reference to FIG. 8 and according to one embodiment of the present invention A-frame 20 has a reinforcement member 200 providing additional support to opposing legs 40 and 50 and barricade beam 30. A worker skilled in the relevant art would be familiar with the use of one or more reinforcement members 200 within A-frame 20.

In another embodiment of the present invention, the A-frame would simply consist of the top portion of the A-frame stand described in the attached figures wherein opposing legs could be inserted into the top portion of the A-frame stand. For example, first and second legs could be inserted into a steel bracket only having first and second contact points. By eliminating first and second legs as described and providing means to insert first and second legs after shipment, this would provide a cheaper product for shipment.

In another embodiment of the present invention, the top portion of the A-frame allowing for the insertion of first and second legs could also hinge on itself.

Although the invention has been described above by reference to certain embodiments of the invention, the invention is not limited to the embodiments described above. Modifications and variations of the embodiments described above will occur to those skilled in the art in light of the above teachings. Moreover, with respect to the above description, it is to be repulsed that the optimum dimensional relationships for the component members of the present invention may include variations in size, material, shape, form, funding and manner of operation.

What is claimed is:

1. A barricade comprising:

an n number of barricade beams each having a first end and a second end; and an n+1 number of A-frames each including a pair of opposing legs adapted to support each A-frame, the n+1 number of A-frames further including at least one interconnecting means for connecting the pair of opposing legs to each other, the at least one interconnecting means of each A-frame spacing the pair of opposing legs apart from one another such that a gap is maintained at a top end of the pair of opposing legs, the at least one interconnecting means and the pair of opposing legs defining a first opening of each A-frame, and the gap defining, at least in part, a second opening at a top end of each A-frame above the first opening, wherein the first and second ends of the n number of barricade beams couple to the n+1number of A-frames such that each barricade beam and each A-frame interconnect to form an alternating pattern where adjacent barricade beams pass through the first openings or the second openings of the A-frames to which the barricade beams couple, so that the adjacent barricade beams occupy different openings of the first and second openings, the number n being an integer value that is at least two, and wherein the first and second openings at each A-frame have a horizontal width that is at least 0.5 inches wider than a width of the ends of the barricade beams that pass through the first and second openings allowing lengths of the barricade beams to be positioned at an angle with respect to a depth plane of the A-frames to which the barricade beams couple, and wherein at least one of the n barricade beams couples to at least two A-frames of the n+1 A-frames at an acute angle relative to the depth plane of the at least two A-frames.

2. The barricade of claim 1, wherein the second opening of each of the n+1 A-frames is substantially U-shaped.

3. The barricade of claim 1, wherein the at least one interconnecting means is comprised of one or more steel studded plates.

4. The barricade of claim 1, further comprising one or more spacers positioned between the pair of opposing legs.

5. The barricade of claim 1, wherein the at least one of the n number of barricade beams includes a locking aperture at one of the first and second ends that is adapted to receive a pin to restrict movement of the at least one of the n number of barricade beams through the first opening and/or the second opening.

6. The barricade of claim 1, wherein the n number of barricade beams contain locking apertures that lock into the at least one interconnecting means thereby restricting a longitudinal movement of the n number of barricade beams.

7. The barricade of claim 1, wherein the first and second openings are positioned substantially atop one another.

8. The barricade of claim 1, wherein the first and second openings are offset with respect to each other about a vertical axis.

9. The barricade of claim 1, further comprised of a reinforcement member positioned between the pair of opposing legs.

10. The barricade of claim 1, further comprising:

a pair of spacers that includes a first spacer and a second spacer; and the at least one interconnecting means including a first interconnecting means for connecting the pair of opposing legs and a second interconnecting means for connecting the pair of opposing legs, and wherein the first spacer and the second spacer each couple to the pair of opposing legs and are positioned in between the pair of opposing legs to create the gap between the pair of opposing legs.

11. The barricade of claim 10, wherein the first and second interconnecting means secure the first and second spacers to the pair of opposing legs.

12. The barricade of claim 11, wherein the at least one interconnecting means is a rigid plate.

* * * * *